US007990065B2

(12) United States Patent
Uriu et al.

(10) Patent No.: US 7,990,065 B2
(45) Date of Patent: Aug. 2, 2011

(54) PLASMA DISPLAY PANEL WITH IMPROVED LUMINANCE

(75) Inventors: Eiichi Uriu, Osaka (JP); Hatsumi Komaki, Osaka (JP); Shingo Takagi, Osaka (JP); Akira Kawase, Osaka (JP); Tatsuo Mifune, Osaka (JP)

(73) Assignee: Panasonic Corporation, Osaka (JP)

( * ) Notice: Subject to any disclaimer, the term of this patent is extended or adjusted under 35 U.S.C. 154(b) by 356 days.

(21) Appl. No.: 11/911,175

(22) PCT Filed: Feb. 26, 2007

(86) PCT No.: PCT/JP2007/053474

§ 371 (c)(1),
(2), (4) Date: Oct. 10, 2007

(87) PCT Pub. No.: WO2007/105468

PCT Pub. Date: Sep. 20, 2007

(65) Prior Publication Data

US 2009/0058296 A1 Mar. 5, 2009

(30) Foreign Application Priority Data

Feb. 28, 2006 (JP) ..... 2006-051738

(51) Int. Cl.
*H01J 17/04* (2006.01)

(52) U.S. Cl. ..... 313/582; 313/585

(58) Field of Classification Search ..... 313/582–587
See application file for complete search history.

(56) References Cited

U.S. PATENT DOCUMENTS 6,184,621 B1 * 2/2001 Horiuchi et al. ..... 313/586
6,423,428 B1 * 7/2002 Towns et al. ..... 428/690
6,555,594 B1 4/2003 Fukushima et al.
6,793,850 B2 * 9/2004 Ichikawa et al. ..... 252/511
6,897,610 B1 5/2005 Aoki et al.
2003/0108753 A1 6/2003 Fujii et al.
2003/0228471 A1 12/2003 Hayakawa et al.
2004/0080270 A1 4/2004 Fujitani et al.

FOREIGN PATENT DOCUMENTS

EP 1 168 079 1/2002
EP 1 367 621 12/2003

(Continued)

OTHER PUBLICATIONS

International Search Report of Jun. 5, 2007 issued in the International Application No. PCT/JP2007/053474.

(Continued)

*Primary Examiner* — Toan Ton
*Assistant Examiner* — Fatima Farokhrooz
(74) *Attorney, Agent, or Firm* — Wenderoth, Lind & Ponack L.L.P.

(57) ABSTRACT

The PDP has a front panel, and has a back panel with address electrodes formed thereon. Front panel has display electrodes including first electrodes and second electrodes formed on a front glass substrate, and a dielectric layer covering display electrodes. Further, the first electrodes and the dielectric layer include glass frit, which contains at least one of molybdenum oxide, magnesium oxide and cerium oxide, and also include a softening point exceeding 550° C. The above-described makeup suppresses a coloring phenomenon in the dielectric layer and the front glass substrate, thereby implementing a plasma display panel with a high luminance.

20 Claims, 4 Drawing Sheets

FOREIGN PATENT DOCUMENTS

| | | | |
|---|---|---|---|
| JP | 9-50769 | | 2/1997 |
| JP | 11-16499 | | 1/1999 |
| JP | 2000-48645 | | 2/2000 |
| JP | 2001-195989 | | 7/2001 |
| JP | 2002-25451 | | 1/2002 |
| JP | 2002-53342 | | 2/2002 |
| JP | 2003-54987 | | 2/2003 |
| JP | 2003-128430 | | 5/2003 |
| JP | 2003-131365 | | 5/2003 |
| JP | 2003-208852 | | 7/2003 |
| JP | 2003-226549 | | 8/2003 |
| JP | 2004-22410 | | 1/2004 |
| JP | 2004-127529 | | 4/2004 |
| JP | 2004-284934 | | 10/2004 |
| JP | 2005149987 | * | 6/2005 |
| JP | 2005-332599 | | 12/2005 |
| KR | 9001699 | * | 3/1990 |

OTHER PUBLICATIONS

Supplementary European Search Report and Examiner's Opinion issued Mar. 26, 2010 in connection with corresponding European Application No. 07 71 4906.

* cited by examiner

PLASMA DISPLAY PANEL WITH IMPROVED LUMINANCE

This application is a U.S. National Phase Application of PCT International Application PCT/JP2007/053474 filed on Feb. 26, 2007.

TECHNICAL FIELD

The present invention relates to a plasma display panel used for a display device and the like.

BACKGROUND ART

A plasma display panel (referred to as PDP hereinafter), having the capability of finer resolution and larger screen size, is used in commercial products such as a 65-inch class television set. In recent years, a PDP has been used in so-called "full-spec" high-definition televisions, with the number of scanning lines being twice that of a display device which uses the conventional NTSC method. In addition, a lead-free PDP is demanded to deal with environmental issues.

A PDP is basically composed of a front panel and a back panel. The front panel has a glass substrate made of sodium borosilicate based glass produced by a float process. The front panel further has display electrodes, a dielectric layer, and a protective layer, each formed on one main surface of the glass substrate. A display electrode is composed of striped transparent electrodes and bus electrodes. The dielectric layer, covering the display electrodes, works as a capacitor. The protective layer, made of magnesium oxide (MgO), is formed on the dielectric layer. A bus electrode is composed of a first electrode for reducing the connection resistance and a second electrode for blocking light.

The back panel has a glass substrate; address electrodes, a base dielectric layer, barrier ribs, and a phosphor layer are each formed on one main surface of the glass substrate. The address electrodes are striped. The base dielectric layer covers the address electrodes. The barrier ribs are formed on the base dielectric layer. The phosphor layer, formed between respective barrier ribs, is composed of red, green, and blue phosphor layers, emitting red, green, and blue light, respectively.

The front panel and back panel are arranged so that the surfaces with the electrodes formed thereon face each other, and they are sealed airtight. Further, an Ne—Xe discharge gas is encapsulated in a discharge space partitioned by the barrier ribs, at a pressure of 400 Torr to 600 Torr.

The PDP discharges with an image signal voltage selectively applied to some display electrodes. Ultraviolet light generated with discharge excites each color phosphor layer. Consequently, the PDP emits red, green, and blue light to display a color image.

A bus electrode contains silver to ensure conductivity. The dielectric layer conventionally contains glass frit with a low melting point containing lead oxide as the principal component. However, a PDP containing lead-free glass frit to deal with environmental issues of recent years is disclosed in patent documents such as Japanese Patent Unexamined Publication No. 2003-128430 (patent literature 1), No. 2002-053342 (patent literature 2), and No. H09-050769 (patent literature 3).

For glass frit used when forming bus electrodes, a PDP containing bismuth oxide instead of lead is disclosed in Japanese Patent Unexamined Publication No. 2000-048645 (patent literature 4).

[Patent literature 1] Japanese Patent Unexamined Publication No. 2003-128430

[Patent literature 2] Japanese Patent Unexamined Publication No. 2002-053342

[Patent literature 3] Japanese Patent Unexamined Publication No. H09-050769

[Patent literature 4] Japanese Patent Unexamined Publication No. 2000-048645

SUMMARY OF THE INVENTION

The present invention provides a PDP with a coloring phenomenon in the dielectric layer and the substrate being suppressed and with a high luminance.

The PDP of the present invention has a front panel, and a back panel with address electrodes formed thereon. The front panel has display electrodes having first and second electrodes formed on the front glass substrate, and a dielectric layer covering the display electrodes. Further, the first and second electrodes include glass frit, which contains at least one of molybdenum oxide, magnesium oxide and cerium oxide; and bismuth oxide, with a softening point exceeding 550° C. The above-described makeup provides a PDP with a coloring phenomenon in the dielectric layer and the substrate being suppressed and with a high luminance.

REFERENCE MARKS IN THE DRAWINGS

Figure 1:
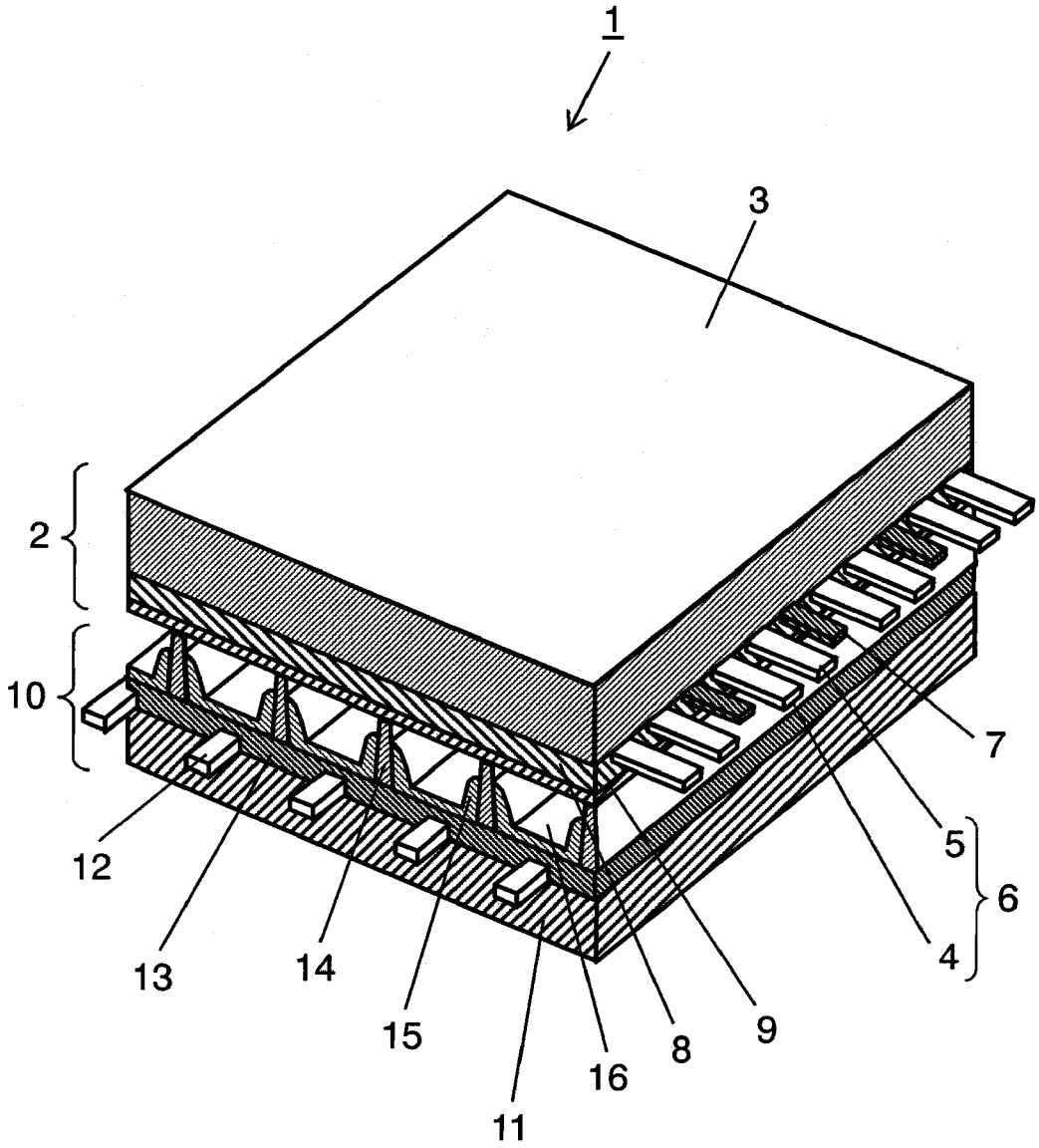
FIG. 1 is a perspective view illustrating the structure of a PDP according to an embodiment of the present invention.

1 PDP
2 Front panel
3 Front glass substrate
4 Scan electrode
4*a*, 5*a* Transparent electrode
4*b*, 5*b* Bus electrode
5 Sustain electrode
6 Display electrode
7 Black stripe
8 Dielectric layer
9 Protective layer
10 Back panel
11 Back glass substrate
12 Address electrode
13 Base dielectric layer
14 Barrier rib
15 Phosphor layer
16 Discharge space
41*b*, 51*b* Second electrode
42*b*, 52*b* First electrode
81 First dielectric layer
82 Second dielectric layer

DETAILED DESCRIPTION OF THE INVENTION

Hereinafter, a description is made of a PDP according to an embodiment of the present invention, with reference to the related drawings.

Exemplary Embodiment

FIG. 1 is a perspective view illustrating the structure of a PDP according to an embodiment of the present invention. The basic structure of the PDP is of the general AC surface-discharge type. As shown in FIG. 1, plasma display panel 1 (referred to as PDP 1 hereinafter) has front panel 2 and back panel 10 facing each other, where the outer circumferences of front panel 2 and back panel 10 are airtight sealed with a sealant (not shown) made of glass frit or the like. This structure forms discharge space 16 inside PDP 1. Further, a discharge gas such as Ne or Xe is encapsulated in discharge space 16 at a pressure of 400 Torr to 600 Torr.

Front panel 2 has front glass substrate 3; display electrodes 6, black stripe 7 acting as a light blocking layer, dielectric layer 8, and protective layer 9 are each formed on front glass substrate 3. Display electrodes 6 are strip-shaped and constitute pairs of scan electrodes 4 and sustain electrodes 5 arranged in parallel to each other. Further, plural series of display electrodes 6 and black stripe 7 are respectively arranged parallel to each other. Dielectric layer 8 is formed so as to cover display electrodes 6 and black stripe 7 to work as a capacitor. Protective layer 9, made of magnesium oxide (MgO) or the like, is formed on the surface of dielectric layer 8.

Back panel 10 has back glass substrate 11; address electrodes 12, base dielectric layer 13, barrier ribs 14, and phosphor layer 15 are each formed on back glass substrate 11. Plural strip-shaped address electrodes 12 are formed orthogonally to scan electrodes 4 and sustain electrodes 5, and are arranged in parallel to each other. Base dielectric layer 13 covers address electrodes 12. Barrier ribs 14, having a given height, are formed on base dielectric layer 13 between address electrodes 12 to partition discharge space 16. Phosphor layer 15 is formed in the grooves between barrier ribs 14 corresponding to each address electrode 12. Phosphor layer 15 is formed by sequentially applying phosphor layers respectively emitting red, blue, or green light, caused by ultraviolet light. A discharge cell is formed where scan electrode 4, sustain electrode 5, and address electrode 12 cross. A discharge cell having phosphor layers 15 for red, blue, and green, arranged in the direction of display electrodes 6 becomes a pixel for color display.

Figure 2:
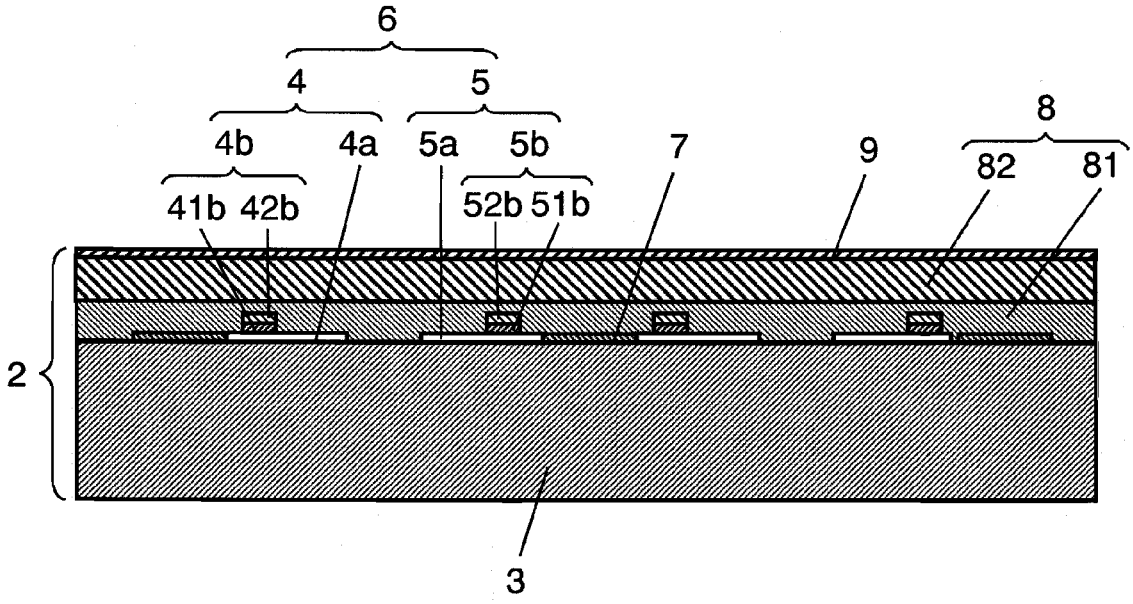
FIG. 2 is a sectional view illustrating the makeup of the front panel used for the PDP shown in FIG. 1.

FIG. 2 is a sectional view illustrating the structure of front panel 2 used for PDP 1 shown in FIG. 1. FIG. 2 shows the image of FIG. 1 vertically inverted. As shown in FIG. 2, front glass substrate 3, produced by float process or the like, has display electrodes 6 and black stripe 7 pattern-formed thereon.

Scan electrode 4 and sustain electrode 5 are composed of transparent electrode 4*a*, 5*a*; and bus electrode 4*b*, 5*b* formed on transparent electrode 4*a*, 5*a*, respectively. Transparent electrodes 4*a*, 5*a* are made of material such as indium oxide (ITO) or tin oxide ($SnO_2$). Bus electrode 4*b*, 5*b* is formed to exert conductivity in the longitudinal direction of transparent electrode 4*a*, 5*a*, composed of white first electrode 42*b*, 52*b* for reducing the electrical resistance; and black second electrode 41*b*, 51*b* for blocking outside light, respectively.

Dielectric layer 8 is provided so as to cover transparent electrodes 4*a*, 5*a*, bus electrodes 4*b*, 5*b*, and black stripe 7. Further, dielectric layer 8 has at least two layers (i.e. first dielectric layer 81, and second dielectric layer 82 formed on first dielectric layer 81). Second dielectric layer 82 has protective layer 9 formed thereon.

Figure 3:
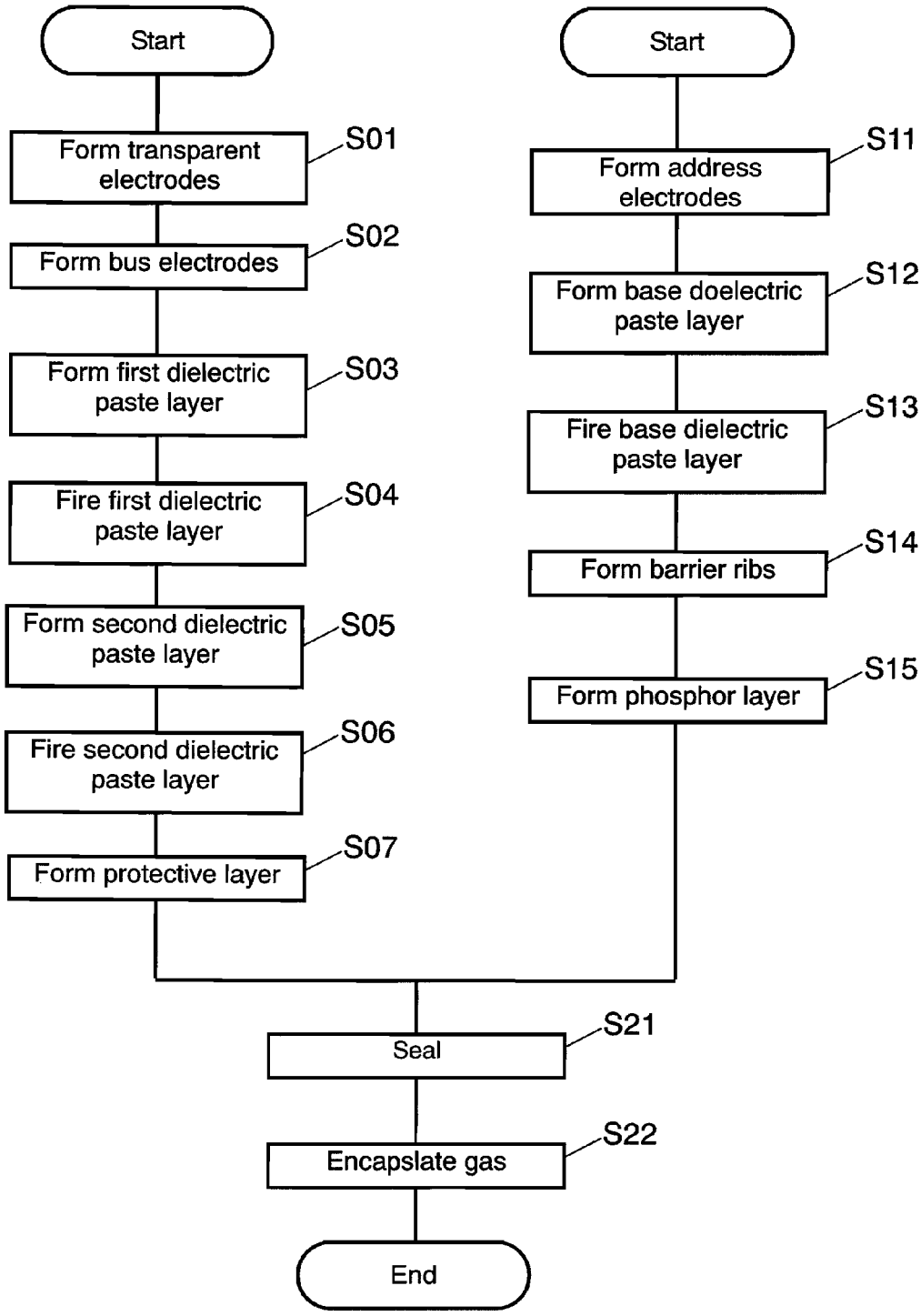
FIG. 3 is a flowchart illustrating a method of manufacturing the PDP shown in FIG. 1.
Figure 4:
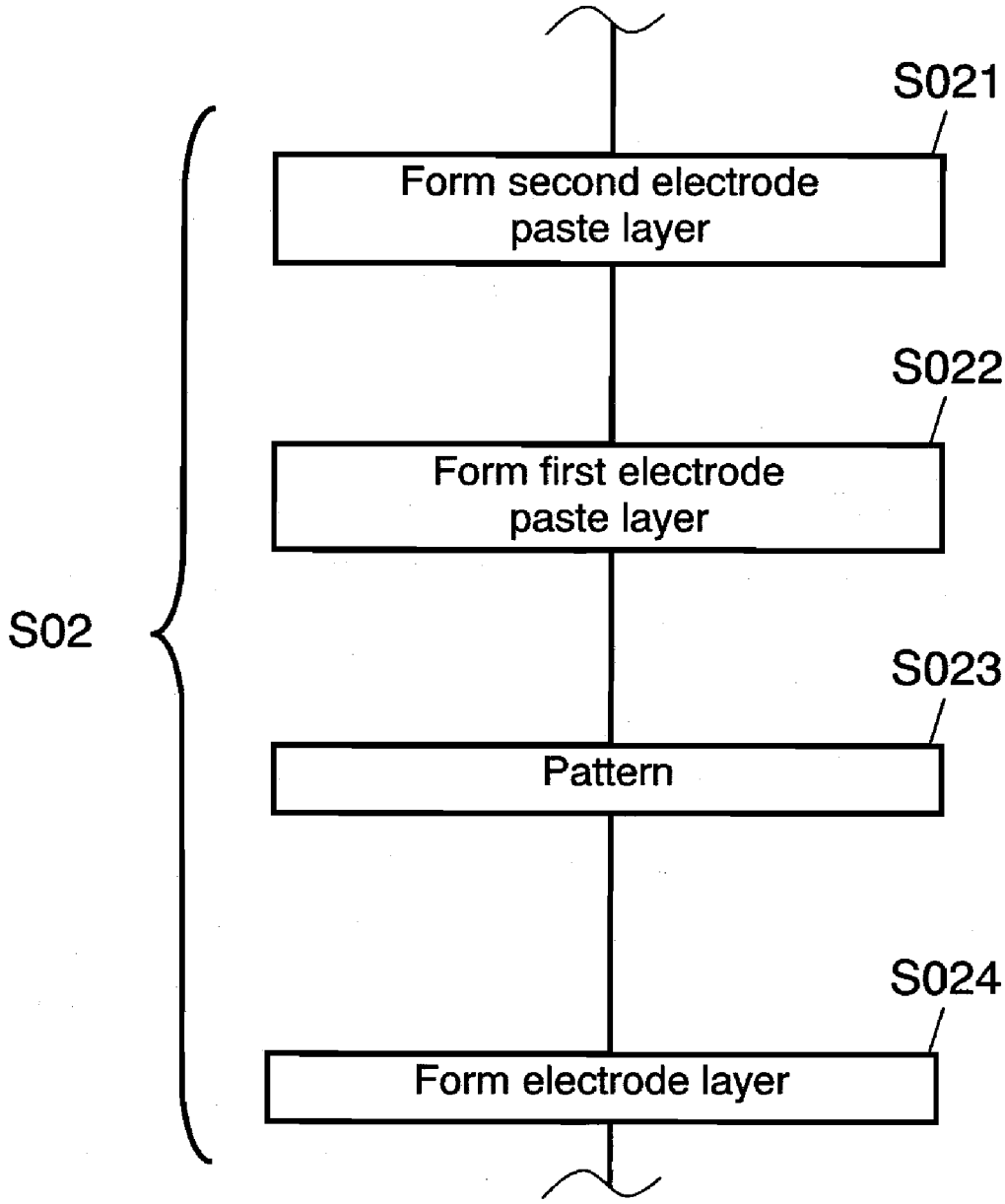
FIG. 4 is a flowchart illustrating a part of the method of manufacturing the PDP shown in FIG. 1.

Next, a description is made for a method of manufacturing PDP 1, using FIGS. 3, 4.

FIG. 3 is a flowchart illustrating a method of manufacturing the PDP shown in FIG. 1. FIG. 4 is a flowchart illustrating the details about the bus electrode forming step of the method of manufacturing the PDP shown in FIG. 1.

Front panel 2 is produced in the following steps. First, scan electrodes 4, sustain electrodes 5, and black stripe 7 are formed on front glass substrate 3. Transparent electrodes 4*a*, 5*a* and bus electrodes 4*b*, 5*b* are formed by patterning using photolithography or the like.

More specifically, a transparent, conductive thin film of such as indium oxide (ITO) or tin oxide ($SnO_2$) is formed using thin film processing or the like. Patterning the transparent, conductive thin film formed on front glass substrate 3 by photolithography forms transparent electrode 4*a*, 5*a* partially composing scan electrode 4 and sustain electrode 5 (S01: transparent electrode forming step).

Next, a paste layer to be black stripe 7 and that to be bus electrodes 4*b*, 5*b* are film-formed by screen printing or the like, and then patterned by photolithography or the like to be formed. Here, a paste layer to be bus electrodes 4*b*, 5*b* is formed on transparent electrodes 4*a*, 5*a*. A paste layer to be bus electrodes 4*b*, 5*b* includes a first electrode paste layer containing silver material and a second electrode paste layer containing conductive black particles. A paste layer to be black stripe 7 is also made of paste material containing black pigment. Further, the paste layer to be black stripe 7 and that to be bus electrode 4*b*, 5*b* are fired at a desired temperature to be solidified (S02: bus electrode forming step). Undergoing the transparent electrode forming step (S01) and the bus electrode forming step (S02) forms scan electrodes 4, sustain electrodes 5, and black stripe 7.

Next, the first dielectric paste is applied by die coating so as to cover scan electrodes 4, sustain electrodes 5, and black stripe 7, thereby forming a first dielectric paste layer to be first dielectric layer 81 (S03: first dielectric paste layer forming step). Further, as a result of the first dielectric paste layer being left standing for a given time after the first dielectric paste is applied, the applied surface of the first dielectric paste layer is leveled to become flat. Here, the first dielectric paste is coating material containing powdered first dielectric glass frit, a binder, and solvent.

Next, the first dielectric paste layer is fired and solidified to form first dielectric layer 81 (S04: first dielectric paste layer firing step).

Next, a second dielectric paste layer to be second dielectric layer 82 is formed by applying the second dielectric paste by die coating so as to cover the first dielectric paste layer (S05: second dielectric paste layer forming step). Further, as a result that the second dielectric paste layer is left standing for a given time after the second dielectric paste is applied, the applied surface of the second dielectric paste layer is leveled to become flat. Here, the second dielectric paste is coating material containing powdered second dielectric glass frit, a binder, and solvent.

Next, the second dielectric paste layer is fired and solidified to form second dielectric layer 82 (S06: second dielectric paste layer firing step). As described above, undergoing the first dielectric paste layer forming step (S03), first dielectric paste layer firing step (S04), second dielectric paste layer forming step (S05), and second dielectric paste layer firing step (S06) forms dielectric layer 8 covering scan electrodes 4, sustain electrodes 5, and black stripe 7.

Next, protective layer 9 made of magnesium oxide is formed on dielectric layer 8 by a vacuum evaporation method (507: protective layer forming step).

Undergoing each step described above forms predetermined constructional elements on front glass substrate 3 to produce front panel 2.

Meanwhile, back panel 10 is produced in the following steps. First, address electrodes 12 are formed on back glass substrate 11 (S11: address electrode forming step). Here, address electrodes 12 are formed as a result of a material layer to be address electrodes 12 being formed on back glass substrate 11 and being fired at a given temperature. The material layer to be address electrodes 12 is formed by a method such as where a paste containing silver material is screen-printed, or patterned by photolithography after a metal film is formed on the whole surface of back glass substrate 11.

Next, a base dielectric paste is applied by die coating or the like so as to cover address electrodes 12 to form a base dielectric paste layer to be base dielectric layer 13 (S12: base dielectric paste layer forming step). Here, as a result of the dielectric paste layer being left standing for a given time after the base dielectric paste is applied, the applied surface of the dielectric paste layer is leveled to become flat. The base dielectric paste is coating material containing powdered dielectric glass frit, a binder, and solvent.

Next, firing the base dielectric paste layer forms base dielectric layer 13 (S13: base dielectric paste layer firing step).

Next, a barrier rib forming paste containing barrier rib material is applied on base dielectric layer 13, and patterned into a given shape to form a barrier rib material layer. After that, firing the barrier rib material layer forms barrier ribs 14 (S14: barrier rib forming step). Here, a method such as photolithography or sandblasting is used to pattern the barrier rib forming paste applied on base dielectric layer 13.

Next, a phosphor paste containing phosphor material is applied on base dielectric layer 13 between adjacent barrier ribs 14 and on the sides of barrier ribs 14. Then, firing the phosphor paste forms phosphor layer 15 (S15: phosphor layer forming step).

Undergoing each step described above produces back panel 10 with given constructional elements formed on back glass substrate 11.

As described above, front panel 2 and back panel 10, respectively produced, are arranged facing each other so that display electrodes 6 and address electrodes 12 are orthogonalized, and the peripheries of front panel 2 and back panel 10 are sealed with a sealant (S21: seal step). Consequently, discharge space 16 partitioned by barrier ribs 14 is formed in the space between front panel 2 and back panel 10 mutually facing.

Next, encapsulating a discharge gas containing a noble gas such as neon or xenon in discharge space 16 produces PDP 1 (S22: gas encapsulating step).

Next, further details are described about display electrodes 6 and dielectric layer 8, both provided on front panel 2.

Display electrode 6 is formed by sequentially laminating transparent electrode 4*a*, 5*a*; second electrode 41*b*, 51*b*; and first electrode 42*b*, 52*b*, on front glass substrate 3. First, after indium oxide with a thickness of approximately 0.12 μm is formed on the whole surface of front glass substrate 3 by sputtering, transparent electrodes 4*a*, 5*a*, striped with a width of 150 μm, are formed by photolithography (S01: transparent electrode forming step).

Next, a second electrode paste to be second electrode 41*b*, 51*b* is applied on the whole surface of front glass substrate 3, by a printing method or the like, to form a second electrode paste layer (S021: second electrode paste layer forming step).

Here, the second electrode paste layer becomes second electrodes 41*b*, 51*b*, and black stripe 7 by being patterned and fired.

The second electrode paste contains conductive black particles of 70 wt % to 90 wt %, second glass frit of 1 wt % to 15 wt %, and a photosensitive organic binder component of 8 wt % to 15 wt %. The conductive black particles are at least one kind of black metal microparticles selected from the group of Fe, Co, Ni, Mn, Ru, and Rh; or metal oxide microparticles containing these black metals. The photosensitive organic binder component contains photosensitive polymer, photosensitive monomer, a light polymerization initiator, solvent, and others. The second glass frit contains at least bismuth oxide ($Bi_2O_3$) of 20 wt % to 50 wt %. The second glass frit further contains at least one material out of molybdenum oxide ($MoO_3$), magnesium oxide (MgO), and cerium oxide ($CeO_2$). The second glass frit further has a softening point exceeding 550° C.

Here, a paste layer to be black stripe 7 may be formed with material different from that of the second electrode paste layer to be second electrodes 41*b*, 51*b*, and by a different method. However, using the second electrode paste layer as a paste layer to be black stripe 7 dispenses with the step of independently providing black stripe 7, thereby improving the production efficiency.

Next, the first electrode paste is applied on the second electrode paste layer by printing method or the like, to form a first electrode paste layer (S022: first electrode paste layer forming step).

Here, the first electrode paste contains at least silver particles of 70 wt % to 90 wt %, glass frit of 1 wt % to 15 wt %, and photosensitive organic binder component of 8 wt % to 15 wt %. The photosensitive organic binder component contains photosensitive polymer, photosensitive monomer, a light polymerization initiator, solvent, and others. The first glass frit contains at least bismuth oxide ($Bi_2O_3$) of 20 wt % to 50 wt %. The first glass frit further contains at least one material out of molybdenum oxide ($MoO_3$), magnesium oxide (MgO), and cerium oxide ($CeO_2$). The first glass frit further has a softening point exceeding 550° C.

Next, the second and first electrode paste layers applied on the whole surface of front glass substrate 3 are patterned by photolithography or the like (S023: patterning step).

Firing the second and first electrode paste layers, after being patterned, at 550° C. to 600° C. produces second electrodes 41*b*, 51*b* and first electrodes 42*b*, 52*b* with a line width of approximately 60 μm, on transparent electrodes 4*a*, 5*a* (S024: electrode layer firing step). In the same way, black stripe 7 is formed by being fired as well in the electrode layer firing step (S024).

Here, the first glass frit used for first electrodes 42*b*, 52*b* and the second glass frit used for second electrodes 41*b*, 51*b* contain bismuth oxide ($Bi_2O_3$) of 20 wt % to 50 wt %. The first and second glass frits are glass material containing, in addition to bismuth oxide, boron oxide ($B_2O_3$) of 15 wt % to 35 wt %, silicon oxide ($SiO_2$) of 2 wt % to 15 wt %, aluminium oxide ($Al_2O_3$) of 0.3 wt % to 4.4 wt %, and others. The first and second glass frits further contain at least one material out of molybdenum oxide ($MoO_3$), magnesium oxide (MgO), and cerium oxide ($CeO_2$). Here, the first and second glass frits may have the same material composition with completely the same composition ratio or with a different ratio.

In a conventional PDP, glass frit with a low softening point (450° C. to 550° C.) is used, where the firing temperature is 550° C. to 600° C. That is, the firing temperature is approximately 100° C. higher than the softening point of the glass frit.

Accordingly, the bismuth oxide itself, with a high reactivity, contained in the glass frit reacts vigorously with silver and black metal microparticles, or with an organic binder component contained in the paste, to generate bubbles in bus electrodes 4*b*, 5*b* and dielectric layer 8, thereby deteriorating the dielectric strength of dielectric layer 8 in some cases.

However, for PDP 1 of the present invention, the softening point of the first and second glass frits exceeds 550° C., and the firing temperature is 550° C. to 600° C. That is, the softening point of the first and second glass frits is close to the firing temperature, thus depressing the reaction of silver and black metal microparticles or an organic component, with bismuth oxide. This decreases bubbles occurring in bus electrodes 4*b*, 5*b* and dielectric layer 8. Here, a softening point of the glass frit higher than 600° C. tends to depress the adhesiveness of bus electrodes 4*b*, 5*b*, transparent electrodes 4*a*, 5*a*, front glass substrate 3, and dielectric layer 8. Accordingly, the softening point of the first and second glass frits is preferably higher than 550° C. and lower than 600° C.

Next, a detailed description is made for first dielectric layer 81 and second dielectric layer 82 composing dielectric layer 8 of front panel 2.

First, a first dielectric paste is applied on front glass substrate 3 by die coating or screen printing so as to cover the second and first electrode paste layers. The first dielectric paste, after being applied, is dried and fired to form a first dielectric paste layer (S03: first dielectric paste layer forming step).

The first dielectric glass material contained in first dielectric layer 81 is composed in the following material composition. That is, the first dielectric glass material contains bismuth oxide ($Bi_2O_3$) of 25 wt % to 40 wt %, zinc oxide of 27.5 wt % to 34 wt %, boron oxide ($B_2O_3$) of 17 wt % to 36 wt %, silicon oxide ($SiO_2$) of 1.4 wt % to 4.2 wt %, aluminium oxide ($Al_2O_3$) of 0.5 wt % to 4.4 wt %. The first dielectric glass material further contains at least one kind of material of 5 wt % to 13 wt % selected from calcium oxide (CaO), strontium oxide (SrO), and barium oxide (BaO). The first dielectric glass material still further contains at least one kind of material of 0.1 wt % to 7 wt % selected from molybdenum oxide ($MoO_3$) and tungsten oxide ($WO_3$). The first dielectric glass material may contain, instead of molybdenum oxide ($MoO_3$) and tungsten oxide ($WO_3$), at least one kind of material of 0.1 wt % to 7 wt % selected from cerium oxide ($CeO_2$), copper oxide (CuO), manganese dioxide ($MnO_2$), chromium oxide ($Cr_2O_3$), cobalt oxide ($CO_2O_3$), vanadium oxide ($V_2O_7$), and antimony oxide ($Sb_2O_3$).

The first dielectric glass material with the composition is crushed so as to be 0.5 μm to 2.5 μm in average particle diameter using a wet jet mill or ball mill to produce first dielectric glass frit. Next, the first dielectric glass frit of 55 wt % to 70 wt % and a binder component of 30 wt % to 45 wt % are kneaded using a triple roll mill to produce a first dielectric paste for die coating or printing. Here, the binder component contained in the first dielectric paste is terpineol or butyl carbitol acetate, containing ethyl cellulose or acrylic resin of 1 wt % to 20 wt %. A plasticizer, dispersant, or the like may be added into the first dielectric paste as required to improve the print quality. A plasticizer to be added includes di-octyl phthalate, di-butyl phthalate, triphenyl phosphate, or tributyl phosphate, for example. A dispersant to be added includes glycerol monooleate, sorbitan sesquioleate, Homogenol (registered trademark of Kao Corporation), or alkylallylic phosphate ester, for example.

Next, the first dielectric layer paste layer is fired at 575° C. to 590° C., slightly higher than the softening point of the first dielectric glass frit (S04: first dielectric paste layer firing step). This process forms first dielectric layer 81 covering the second and first electrode paste layers and black stripe 7.

Next, a second dielectric paste is applied on the first dielectric paste layer by screen printing or die coating. The second dielectric paste, after being applied, is dried to form a second dielectric paste layer (S05: second dielectric paste layer forming step).

The second dielectric glass material contained in second dielectric layer 82 has the following material composition. That is, the second dielectric glass material contains bismuth oxide ($Bi_2O_3$) of 11 wt % to 20 wt %, zinc oxide (ZnO) of 26.1 wt % to 39.3 wt %, boron oxide ($B_2O_3$) of 23 wt % to 32.2 wt %, silicon oxide ($SiO_2$) of 1 wt % to 3.8 wt %, and aluminium oxide ($Al_2O_3$) of 0.1 wt % to 10.2 wt %. The second dielectric glass material further contains at least one kind of material of 9.7 wt % to 29.4 wt % selected from calcium oxide (CaO), strontium oxide (SrO), and barium oxide (BaO). The second dielectric glass material still further contains cerium oxide ($CeO_2$) of 0.1 wt % to 5 wt %.

The second dielectric glass material with the composition is crushed so as to be 0.5 μm to 2.5 μm in average particle diameter using a wet jet mill or ball mill to produce second dielectric glass frit. Next, the second dielectric glass frit of 55 wt % to 70 wt % and a binder component of 30 wt % to 45 wt % are kneaded using a triple roll mill to produce a second dielectric paste for die coating or printing. Here, the binder component contained in the second dielectric paste is terpineol or butyl carbitol acetate, containing ethyl cellulose or acrylic resin of 1 wt % to 20 wt %. A plasticizer, dispersant, or the like may be added into the second dielectric paste as required to improve the print quality. A plasticizer to be added includes di-octyl phthalate, di-butyl phthalate, triphenyl phosphate, or tributyl phosphate, for example. A dispersant to be added includes glycerol monooleate, sorbitan sesquioleate, Homogenol (registered trademark of Kao Corporation), or alkylallylic phosphate ester, for example.

Next, the second dielectric layer paste layer is fired at 550° C. to 590° C., slightly higher than the softening point of the second dielectric glass frit (S06: second dielectric paste layer firing step). This process forms second dielectric layer 82 covering first dielectric layer 81, and these layers form dielectric layer 8.

The film thickness of dielectric layer 8, including first dielectric layer 81 and second dielectric layer 82, is preferably smaller than 41 μm to ensure the transmittance of visible light. First dielectric layer 81 contains bismuth oxide of 25 wt % to 40 wt %, which is more than that contained in the second dielectric layer 82, to suppress the reaction with silver contained in bus electrodes 4*b*, 5*b*. Accordingly, the visible-light transmittance of first dielectric layer 81 is lower than that of second dielectric layer 82. The film thickness of first dielectric layer 81 is thus thinner than that of second dielectric layer 82, thereby ensuring the transmittance of visible light transmitting through dielectric layer 8.

Second dielectric layer 82 containing bismuth oxide of less than 11 wt % is resistant to a coloring phenomenon, while bubbles are subject to occurring in second dielectric layer 82. Meanwhile, if the percentage of bismuth oxide content exceeds 20 wt %, a coloring phenomenon tends to occur, making it difficult to increase the transmittance. Consequently, the percentage of bismuth oxide content in the second dielectric paste is preferably 11 wt % to 20 wt %.

As the film thickness of dielectric layer 8 becomes thinner, the panel luminance is improved and the discharge voltage is decreased more prominently. Accordingly, the film thickness of dielectric layer 8 is desirably thinnest possible as long as the dielectric strength does not decrease. From such a view-point, the film thickness of dielectric layer 8 is set to 41 μm or thinner; first dielectric layer 81, 5 μm to 15 μm; and second dielectric layer 82, 20 μm to 36 μm, in the embodiment of the present invention.

As described above, PDP 1 is resistant to a coloring phenomenon such as yellowing in front glass substrate 3 even if silver material is used for display electrode 6. In addition, bubbles in dielectric layer 8 do not occur, thereby implementing dielectric layer 8 with high dielectric strength.

Next, in PDP 1 according to the present invention, consideration is made for reasons why a coloring phenomenon in front glass substrate 3 and in first dielectric layer 81, and bubbles occurring in first dielectric layer 81 are suppressed.

In a conventional PDP, high-definition TV requires the number of scanning lines to be increased; more specifically, the number of display electrodes increases and their spacing decreases. Accordingly, more silver ions diffuse from silver electrodes composing display electrodes to the dielectric layer or glass substrate. Diffusion of silver ions ($Ag^+$) to the dielectric layer or glass substrate causes the silver ions ($Ag^+$) to undergo reduction due to alkali metal ions in the dielectric layer or divalent tin ions contained in the glass substrate. This effect generates colloidal silver, thereby yellowing or browning the dielectric layer or glass substrate.

In PDP 1 of the present invention, meanwhile, at least one material out of molybdenum oxide, magnesium oxide, and cerium oxide is added to the first and second glass frits. Reaction of these materials with silver ions ($Ag^+$) generates a compound containing silver such as $Ag_2MoO_4$, $Ag_2MO_2O_7$, $Ag_2MO_4O_{13}$, AgMgO, or $Ag_2CeO_3$, at a low temperature of 580° C. or lower.

In the present invention, the firing temperature of dielectric layer 8 is 550° C. to 590° C. Consequently, silver ions ($Ag^+$) diffusing in dielectric layer 8 react with molybdenum oxide, magnesium oxide, or cerium oxide, contained in first electrode 42*b*, 52*b* and second electrode 41*b*, 51*b*, while dielectric layer 8 is being fired, to generate a stable compound, thereby stabilizing the silver ions ($Ag^+$). In other words, silver ions ($Ag^+$) are stabilized without undergoing reduction. Accordingly, silver ions ($Ag^+$) do not generate colloids due to aggregation of the silver ions ($Ag^+$). Stabilized silver ions ($Ag^+$) decrease oxygen occurring involved in colloidal silver, resulting in fewer bubbles generated in dielectric layer 8.

In dielectric layer 8 used for PDP 1 of the present invention, a coloring phenomenon and bubble occurrence are suppressed in first dielectric layer 81 contacting first electrode 42*b*, 52*b* containing silver material. Further, second dielectric layer 82 provided on first dielectric layer 81 implements a high transmittance of visible light. In addition, first glass frit used for first electrode 42*b*, 52*b* and second glass frit used for second electrode 41*b*, 51*b* contain at least bismuth oxide ($Bi_2O_3$) of 20 wt % to 50 wt %. The first and second glass frits further contain at least one material out of molybdenum oxide ($MoO_3$), magnesium oxide (MgO), and cerium oxide ($CeO_2$), and have a softening point exceeding 550° C., thus further suppressing bubbles occurring from bus electrode 4*b*, 5*b*. As a result, a coloring phenomenon such as yellowing of front glass substrate 3 is unlikely to occur, thus implementing PDP 1 with a high transmittance owing to extremely limited likelihood of the occurrence of bubbles and a coloring phenomenon in whole dielectric layer 8.

In PDP 1 of the present invention, when address electrodes 12 are formed on the back glass substrate 11, address electrodes 12 contain at least silver and third glass frit. Further, the third glass frit contains at least bismuth oxide ($Bi_2O_3$) and has a softening point exceeding 550° C. Consequently, in the same way as in the relationship between bus electrode 4*b*, 5*b* and dielectric layer 8, described above, bubbles occurring from address electrodes 12 are suppressed, thereby improving the dielectric strength of base dielectric layer 13. Consequently, the reliability of back panel 10 is improved.

A base dielectric paste to be base dielectric layer 13 preferably has material composition which is the same as that of a first dielectric paste. That is, base dielectric glass frit contained in the base dielectric paste has material composition same as that of the first dielectric glass frit. Consequently, in the same way as in the relationship between bus electrode 4*b*, 5*b* and dielectric layer 8, described above, bubbles occurring from address electrodes 12 are further suppressed. Accordingly, a coloring phenomenon such as yellowing of second substrate 11 is unlikely to occur, thus implementing PDP 1 with extremely limited likelihood of the occurrence of bubbles and a coloring phenomenon in whole base dielectric layer 13. Consequently, the dielectric strength of base dielectric layer 13 is improved, and so is the reliability of back panel 10.

As described above, PDP 1 of the present invention has front panel 2 with a high transmittance of visible light and high dielectric strength, and has back panel 10 with high dielectric strength. Accordingly, PDP 1 is implemented with a high reliability and environmental friendliness owing to being free from a lead component.

INDUSTRIAL APPLICABILITY

As described above, the present invention implements a PDP which is environmentally friendly and superior in display quality as a result of a coloring phenomenon and deterioration of the dielectric strength in the dielectric layer are suppressed, and thus the PDP is useful for a large-screen display device and the like.

The invention claimed is:

1. A plasma display panel comprising:

a front panel including a front glass substrate, a display electrode, and a dielectric layer covering the display electrode; and a back panel including a back glass substrate and an address electrode formed on the back glass substrate, wherein the display electrode includes a bus electrode, and the bus electrode includes a first electrode and a second electrode formed under the first electrode, the first electrode containing silver, wherein the front panel and the back panel are arranged facing each other, and a discharge space is formed between the front panel and the back panel, wherein the first electrode and the second electrode include glass frit, the glass frit containing at least one of molybdenum oxide and cerium oxide, and wherein the glass frit has a softening point higher than 550° C. and contains bismuth oxide.

2. The plasma display panel of claim 1, wherein the glass frit has a bismuth oxide content of 20 wt % to 50 wt %.

3. The plasma display panel of claim 1, wherein the address electrode contains silver and glass frit; and wherein the glass frit contained in the address electrode contains bismuth oxide and has a softening point higher than 550° C.

4. The plasma display panel of claim 1, wherein the dielectric layer has a bismuth oxide content of 25 wt % to 40 wt %.

5. The plasma display panel of claim 1, wherein the glass frit of the first electrode and the second electrode contains molybdenum oxide.

6. The plasma display panel of claim 1, wherein the glass frit of the first electrode and the second electrode contains cerium oxide.

7. The plasma display panel of claim 1, wherein the each of the first glass frit and the second glass frit has a bismuth oxide content of 20 wt % to 50 wt %.

8. The plasma display panel of claim 2, wherein the dielectric layer has a bismuth oxide content of 25 wt % to 40 wt %.

9. A plasma display panel comprising:

a front panel including a front glass substrate, a display electrode, and a dielectric layer covering the display electrode; and a back panel including a back glass substrate and an address electrode formed on the back glass substrate, wherein the display electrode includes a transparent electrode connected to the front glass substrate and a bus electrode connected to the transparent electrode on the opposite side of the transparent electrode from the front glass substrate, wherein the bus electrode includes a first electrode and a second electrode, the second electrode being connected to the transparent electrode, and the first electrode being connected to the second electrode on the opposite side of the second electrode from the transparent electrode, wherein the first electrode contains silver and includes a first glass frit, the first glass frit contains bismuth oxide and at least one of molybdenum oxide and cerium oxide, and the first glass frit has a softening point higher than 550° C., wherein the second electrode includes a second glass frit, the second glass frit contains bismuth oxide and at least one of molybdenum oxide and cerium oxide, and the second glass frit has a softening point higher than 550° C., wherein the front panel and the back panel are arranged facing each other, and a discharge space is formed between the front panel and the back panel.

10. The plasma display panel of claim 9, wherein the each of the first glass frit and the second glass frit has a bismuth oxide content of 20 wt % to 50 wt %.

11. The plasma display panel of claim 9, wherein the address electrode contains silver and glass frit; and wherein the glass frit contained in the address electrode contains bismuth oxide and has a softening point higher than 550° C.

12. The plasma display panel of claim 9, wherein the dielectric layer has a bismuth oxide content of 25 wt % to 40 wt %.

13. The plasma display panel of claim 9, wherein each of the first glass frit and the second glass frit contains molybdenum oxide.

14. The plasma display panel of claim 9, wherein each of the first glass frit and the second glass frit contains cerium oxide.

15. The plasma display panel of claim 10, wherein the dielectric layer has a bismuth oxide content of 25 wt % to 40 wt %.

16. A plasma display panel comprising:

a front panel including a front glass substrate, a display electrode, and a dielectric layer covering the display electrode; and a back panel including a back glass substrate and an address electrode formed on the back glass substrate, wherein the display electrode includes a transparent electrode connected to the front glass substrate and a bus electrode connected to the transparent electrode, wherein the bus electrode includes a first electrode and a second electrode, the second electrode being connected to the transparent electrode, and the first electrode being connected to the second electrode, wherein the first electrode contains silver and includes a first glass frit, the first glass frit contains bismuth oxide and at least one of molybdenum oxide and cerium oxide, and the first glass frit has a softening point higher than 550° C., wherein the second electrode includes a second glass frit, the second glass frit contains bismuth oxide and at least one of molybdenum oxide and cerium oxide, and the second glass frit has a softening point higher than 550° C., wherein the front panel and the back panel are arranged facing each other, and a discharge space is formed between the front panel and the back panel.

17. The plasma display panel of claim 16, wherein the address electrode contains silver and glass frit; and wherein the glass frit contained in the address electrode contains bismuth oxide and has a softening point higher than 550° C.

18. The plasma display panel of claim 16, wherein the dielectric layer has a bismuth oxide content of 25 wt % to 40 wt %.

19. The plasma display panel of claim 16, wherein each of the first glass frit and the second glass frit contains molybdenum oxide.

20. The plasma display panel of claim 16, wherein each of the first glass frit and the second glass frit contains cerium oxide.

* * * * *